US005478687A

United States Patent [19]

Ogawa et al.

[11] Patent Number: 5,478,687

[45] Date of Patent: Dec. 26, 1995

[54] CARRIER FOR NEGATIVELY CHARGEABLE DEVELOPER

[75] Inventors: Keiko Ogawa; Meizo Shirose; Michiaki Ishikawa, all of Hachioji, Japan

[73] Assignee: Konica Corporation, Japan

[21] Appl. No.: 204,990

[22] Filed: Mar. 1, 1994

[30] Foreign Application Priority Data

Mar. 8, 1993 [JP] Japan ..... 5-046755

[51] Int. Cl.[6] ..... G03G 9/107; G03G 9/113

[52] U.S. Cl. ..... 435/106.6; 430/108

[58] Field of Search ..... 430/106.6, 108

[56] References Cited

U.S. PATENT DOCUMENTS 5,075,158 12/1991 Kouno et al. ..... 430/108 X

FOREIGN PATENT DOCUMENTS

| | | | |
|---|---|---|---|
| 21730 | 2/1979 | Japan | 430/108 |
| 168255 | 10/1982 | Japan | 430/108 |
| 117555 | 7/1983 | Japan | 430/108 |
| 232362 | 12/1984 | Japan | 430/108 |
| 191155 | 8/1989 | Japan | 430/108 |
| 83 | 1/1990 | Japan | 430/108 |
| 110474 | 4/1990 | Japan | 430/108 |
| 124677 | 4/1992 | Japan | 430/108 |

*Primary Examiner*—Roland Martin
*Attorney, Agent, or Firm*—Jordan B. Bierman; Bierman and Muserlian

[57] ABSTRACT

Disclosed is a carrier for a negatively chargeable developer comprising magnetic particles and provided thereon, having a layer comprising a hydrophilic silica having a degree of degree of hydrophobicity of less than 20 and resin particles.

9 Claims, 1 Drawing Sheet

CARRIER FOR NEGATIVELY CHARGEABLE DEVELOPER

FIELD OF THE INVENTION

This invention relates to a carrier for negatively chargeable developer applicable, in an electrophotography, to develop a negatively charged latent image formed on the surface of either an organic photoreceptor or an amorphous silicone photoreceptor.

BACKGROUND OF THE INVENTION

The methods for coating a carrier are roughly classified into the following two kinds.

One of the methods is called a solvent-coating method such as a fluidized layer type spray-coating method in which a coating solution is prepared by dissolving a coating resin in a solvent and the resulting coating solution is spray-coated on the surfaces of magnetic particles by making use of a fluidized layer and is then dried up; a dip-coating method in which a coating solution is prepared by dissolving a coating resin in a solvent and magnetic particles are dipped in the resulting coating solution to be coated thereon and then dried them up; and a sintering type coating method in which a coating solution is prepared by dissolving a coating resin in a solvent and is then coated on the surfaces of magnetic particles and, further, the resin is sintered; and the other of the two methods is called a dry type coating method such as those methods described in Japanese Patent Publication Open to Public Inspection (hereinafter referred to as JP OPI Publication) Nos. 2-8860/1990 and 3-144579/1991, in which a mechanical impact is applied to a resin to be coated on and fixed to a carrier.

An improvement of the environmental difference in the chargeability of a developer has been attempted by making a carrier hydrophobic, as described in JP OPI Publication No. 59-228261/1984 on a silicon resin-coated carrier).

The advantages of a dry-type coating carrier are that a carrier can be prevented from becoming large in particle-size because no solvent is used therein, so that a granularity can be made lower, and that a yield can be increased, because any required particle-size distribution can be provided. Further, because no drying step is not required, so that a carrier can be prepared in a short time and the productivity can also be higher. In addition to the above, a coating treatment can be so performed as to make the coated surfaces uniform without any unevenness as compared to any solvent-coating type carriers, because a resin is fixed by applying a mechanical impact after fine-particles are made uniformly adhered in advance by making a stirring treatment in the first processing step.

However, when coating two or more kinds of fine-particles, each kind of the particles can hardly be mixed up together so that the fluidity of a coating agent may seriously lowered, and a great deal of coated places and a few coated places are localized. Therefore, any uniformly coated surfaces cannot be obtained. In particular, such a phenomenon as mentioned above is liable to produce when the chargeability and/or particle-sizes of individual fine-particles are different from each other. A carrier having a unevenly coated layer is slow in charging rise-time so that a toner-flying phenomenon is liable to produce especially under a low-temperature and low-humidity conditions, because the mixability thereof with toner is low.

When making use of a means for making carriers hydrophobic, an environmental difference is little in the case where the toner side is relatively hydrophobic. However, as in recent years, when a toner is added thereto with inorganic fine-particles for improving the characteristics thereof, the toner is liable to adsorb moisture by itself and the triboelectric series thereof is varied by an environment. Therefore, rather on the contrary, when making a toner hydrophobic, the environmental difference of the charged amounts of a developer is resulted to be greater. When the environmental difference of the charged amounts thereof is greater, the charging amount is lowered under a high-temperature and high-humidity conditions and, resultingly, an image-transfer property us lowered, because an image-transfer failure and so forth are produced. Under the low-temperature and low-humidity conditions, a charged amount is made higher, so that a lack of developability may resultingly be produced and so it goes. Therefore, when an environment is changed, such an inconvenience may be produced that the resulting images are seriously varied, even if the same developer should be used.

SUMMARY OF THE INVENTION

It is an object of the invention to improve the environmental difference of the chargeability of a negatively chargeable developer.

Another object of the invention is to improve the uniformity of the carrier-coated later of a negatively chargeable developer and the charging rise-time thereof and, particularly, to improve the charging rise-time under the low-temperature and low-humidity conditions.

The objects of the invention can be achieved with a carrier for negatively chargeable developer comprising magnetic particles coated thereon with hydrophilic silica having a degree of hydrophobicity ratio of less than 20 and resin particles in a dry-coating method for applying a mechanical impact to coat and fix said silica and resin particles to said magnetic particles. The degree of hydrophobicity ratio of a hydrophobic silica is indicated by a value of methanol-wettability and is preferable to be less than 15. When the moisture of a carrier is adsorbed for a measure to make an environmental difference less, that is, for preventing the environmental variations of a carrier itself, the measure can be achieved with the use of a material of which the chargeability is weakly made to be negative.

Figure 1:
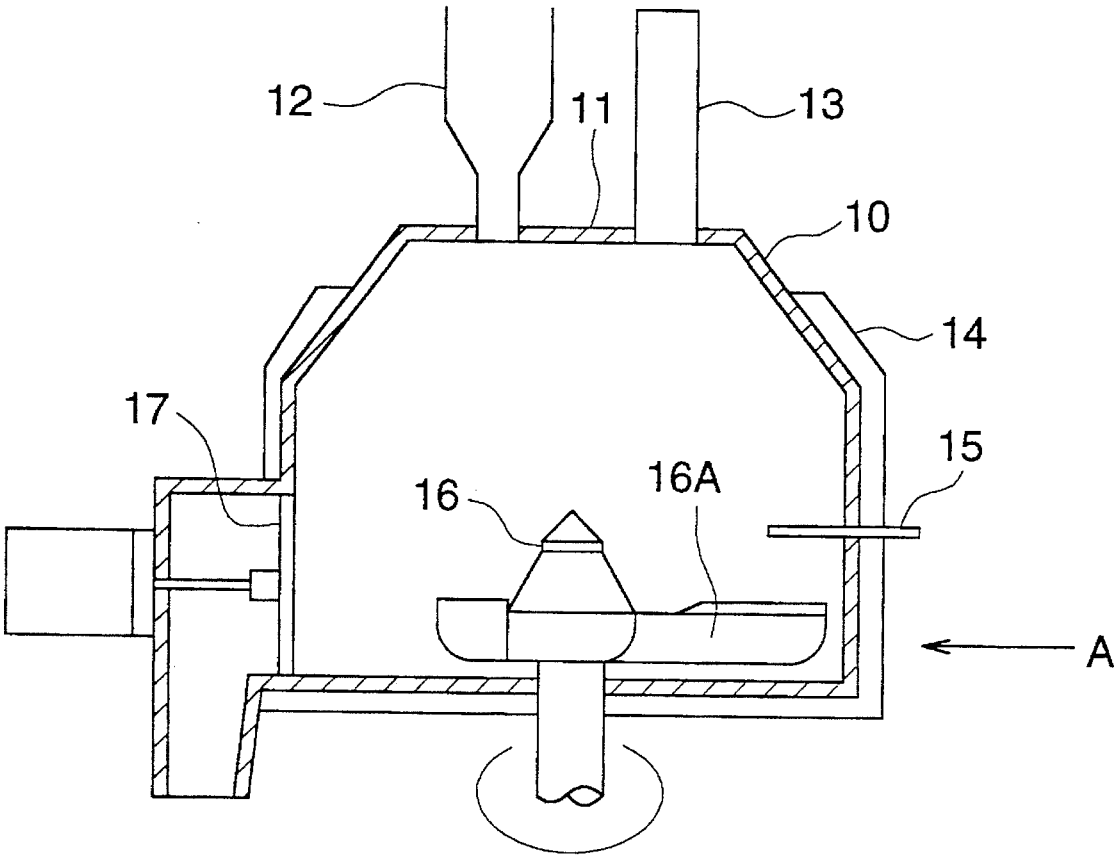
FIG. 1 represents a cross section showing a constitution of a dry coating apparatus.

10: Main vessel
11: Upper lid
12: Inlet for loading raw material
13: Bug filter
14: Jacket
15: Thermometer
16: Main mixing fan
17: Outlet for product
16A: Stirring blade

DETAILED DESCRIPTION OF THE INVENTION

As for the magnetic particles applicable to the invention, a metal such as iron, nickel and cobalt including iron, ferrite and magnetite, or an alloy or compound each containing such a metal as given above. Among them, it is preferable when making use of magnetic particles each having a specific gravity within the range of 3 to 7 because a stress applied to a developer can be reduced when a mixing-stirring treatment is carried out inside a developing machine, also because a toner can hardly be spent by destroying a carrier-coated layer and/or by fusing it into carrier surfaces.

Next, Resin particles applicable to the invention will be detailed. As for the resins for the resin particles, for example, styrene type resins, acryl type resins, styrene-acryl type resins, vinyl type resins, ethylene type resins, rosin-denatured resins, polyamide resins, polyester resins and so forth may be used. It is also allowed to make combination use of these resins. Among them, styrene type resins, acryl type resins, styrene-acryl type resins are preferable, and styrene-acryl type resins are particularly preferable.

As for the particle size of the resin particle, the particle size of 0.01 to 2.0 μm in terms of primary number average particle size is preferably employed.

As for the hydrophilic silica applicable to the invention, it is preferable to use silica prepared by a high-temperature hydrolysis of silicon chloride compounds in vapor phase, because it is high in purity, excellent in dispersibility to a coated layer, large in surface area and excellent in adsorbing function of water molecules.

Degree of hydrophobicity is an index for indicating a hydrophobic property. Hydrophilic silica having a degree of hydrophobicity (methanol number) of not less than 20 is not satisfactory in water molecular adsorbing property and it has, therefore, an unsatisfactory effect on the cutdown of the environmental difference of charging amounts. It is preferable that silica is to have an average particle-size within the range of 5 to 50 nm in terms of the primary number average particle size. If it is smaller than 5 nm, the particles are liable to form a secondary flocculate, so that the dispersibility thereof to a coated layer is deteriorated. If it exceeds 50 nm, a dispersion to a coated layer can hardly be made and, further, an adsorption of water molecules becomes unsatisfactory, because the specific surface becomes smaller. The primary particle-sizes of silica were confirmed by observing them through a 100,000-power transmission type electron microscope.

A specific surface area of silica is to be obtained in a BET method and it is preferable to be within the range of 40 to 500 $m^2/g$. When a specific area is smaller than 40 $m^2/g$, a water molecular adsorbing function is deteriorated. When exceeding 500 $m^2/g$, a water molecular adsorbing function is too high and, besides, a uniform dispersion to a coated layer can hardly be performed.

The addition amount of the silica is preferably within the range of 10 to 70% by weight, and more preferably 30 to 60% by weight of the total amount of a coated layer of magnetic particle. When the addition amount thereof is less than 10% by weight, an effect on the cutdown of the environmental difference cannot be satisfactory, because the water molecular adsorbing property is not satisfactory. When exceeding 70% by weight, a coated layer can hardly be formed, so that the lowered durability of the layer such as a layer peeling trouble may be induced.

The degree of hydrophobicity of the silica is defined as a value of methanol number, and the definition of the methanol number is disclosed on column 6, lines 5 to 23 of U.S. Pat. No. 4,902,570. The definition of the methanol number is detailed as follows.

To evaluate the hydrophobic properties, use is made of the wetting behavior towards methanol, expressed in methanol numbers. The methanol titration is carried out in the following manner.

About 0.2 g of product is added to 50 ml of distilled water placed in a 250 ml beaker. Methanol is added dropwise from a burette whose tip is immersed in the liquid until the entire amount of the substrate modified, highly dispersed metal oxide is wetted. At the same time, continuous slow stirring is carried out using a magnetic stirrer. The degree of degree of hydrophobicity (methanol number) is calculated from the quantity of methanol, expressed in milliliters, which is required for complete wetting using the equation:

$$\text{Methanol number}=\{(a)/(50+a)\}\times 100$$

A negatively chargeable developer carrier of the invention is prepared in the following process.

In the first preparation step, magnetic particles and hydrophilic silica, and resin particles are mixed and stirred by an ordinary type stirring means, so that the resulting mixture is made uniformly adhered to the surfaces of the magnetic particles by the aid of physical or electrostatic adhesion force. The above-mentioned first step may be carried out under a non-heated condition or under a heating condition of the order of slightly softening the resin particles. When completing the first step carried out as mentioned above, the resulting mixture is stirred under a non-heating or heating condition, and the hydrophilic silica and the resin particles are then fixed to the surface of the magnetic particles by applying impacts repeatedly to the mixture, so that coated carrier can be obtained.

As for the means for performing the above-mentioned first processing step, a variety of mixing/stirring means may be used. It is, however, preferable to use a means also capable of successively performing the following secondary processing step.

After completing the first processing step as mentioned above, the secondary processing step is to be successively performed. In the secondary step, the mixture treated in the first step is stirred with a strong stirring power under a non-heating or heating condition and the coating materials (which are resin fine-particles and hydrophilic silica) are then fixed to the surfaces of the primary carrier particles by applying impact repeatedly to the mixture.

Even when performing the secondary step under a non-heating condition, the temperature of the mixture is usually raised to be 30° to 60° C. by an autogenously exothermic reaction generated by the friction of the mixture. By the generated heat, the surfaces of the carriers prepared in the first step are softened, so that the coating materials can readily be fixed to the carrier surfaces. When heating the mixture, a temperature applied thereto is preferably within the range of 60° to 120° C. If a heating temperature is too high, the primary carrier particles are liable to be flocculated together.

As for the toners applicable to the invention, any generally known resins including, for example, a styrene-acryl copolymer, can be used.

(Function)

In a negatively chargeable developer, a toner added thereto with inorganic fine-particles and so forth adsorbs water molecules under a high-humidity condition and thereby the triboelectric series thereof is shifted to the plus-side. Accordingly, in the case that a carrier is hydrophobic, the triboelectric series of toner and carrier becomes smaller, so that the chargeability is lowered, as aforementioned.

In a carrier of the invention, in contrast to the above, the carrier contains a hydrophilic and weakly negative-chargeable silica in the coated layer of the carrier, and the carrier adsorbs water molecules under a high-humidity conditions similar to the case of toner and thereby the triboelectric series thereof is shifted to the plus-side. Therefore, the difference of triboelectric series between toner and carrier is scarcely varied and, resultingly, an almost constant charged amount can be maintained regardless of any surrounding humidity. Therefore, a developability and an image-transferability can be kept stable, regardless of any environments.

On the other hand, when a degree of hydrophobicity of silica contained in a coated layer is not lower than 20, Any environmental difference cannot be improved, because the silica can be hydrophobic, so that water absorption of carrier cannot be insufficient, and also because the same shift of triboelectric series as in the case of toner cannot be made.

Further, according to the carrier coating process of the invention, the coating materials can be improved in fluidity and can also be made uniformly adhered to magnetic particles, because hydrophilic silica can display the effects of a fluidizing agent when mixing the magnetic particles, resin fine-particles and hydrophilic silica in the primary step. Besides the above, different from a solvent-coating process, any layer thickness cannot be fluctuated to be thicker nor thinner, so that a uniform layer formation can be performed, because the granulation of resin itself is substantially few and also because the coating materials are fixed to the carrier by applying a mechanical impact thereto in the secondary step.

EXAMPLES

Now, some embodiments of the invention will be detailed below.

Example 1

In the following process, a negatively chargeable developer carrier was prepared.

To 100 parts by weight of Cu—Zu ferrite particles having a specific gravity of 5.0 and the weight average particle size of 80 μm wherein the saturation magnetization when an external magnetic field with 1000 Oe is applied is 62 emu/g, fine resin grains (the primary number average particle size= 0.10 μm) of a copolymer having composition of MMA/St= 6/4 in weight ratio, hydrophilic silica and the like were added under the blending ratio as shown in Table 1. Next, the mixture was processed for 3 minutes by the use of a high-speed stirring type mixer as shown in FIG. 1 under a stirrer's circumferential speed of the 8 m/sec, so that grains including fine resin grains and hydrophilic silica were adhered to the surface of the Cu—Zn ferrite particles. And then the circumferential speed of the stirrer was set to be 10 m/sec, and stirred for 20 minutes. Thus, carriers of the present invention and carrier for a comparative samples were prepared.

TABLE 1

| | Resin particle | | Hydrophilic silica | | | | |
|---|---|---|---|---|---|---|---|
| Carrier No. | Composition (weight ratio) | Amount added (in part) | Particle-size (nm) | BET surface area ($m^2/g$) | Hydrophobicity (%) | Amount added (in part) | Coating method |
| C-1 | MMA/St = 6/4 | 6 | 12 | 200 | 0 | 6 | Dry system |
| C-2 | MMA/St = 6/4 | 12 | 12 | 200 | 0 | 4 | Dry system |
| C-3 | MMA/St = 6/4 | 7 | 12 | 200 | 0 | 9 | Dry system |
| C-4 | MMA/St = 6/4 | 10 | 7 | 380 | 0 | 10 | Dry system |
| C-5 | MMA/St = 6/4 | 6 | 16 | 130 | 0 | 6 | Dry system |
| C-6 | MMA/St = 6/4 | 6 | 40 | 50 | 0 | 6 | Dry system |
| C-7 | MMA/St = 6/4 | 6 | 12 | 200 | 15 | 6 | Dry system |
| HC-1 | MMA/St = 6/4 | 10 | — | — | — | — | Dry system |
| HC-2 | MMA/St = 6/4 | 10 | — | — | — | — | Solvent system |
| HC-3 | HAA/St = 6/4 | 6 | 12 | 200 | 0 | 6 | Solvent system |
| HC-4 | MMA/St = 6/4 | 6 | R-972 | | | 6 | Dry system |
| HC-5 | MMA/St = 6/4 | 6 | Hydrophilic titanium particle | | | 6 | Dry system |
| HC-6 | MMA/St = 6/4 | 6 | Bontron E-81 | | | 6 | Dry system |

MMA: Methyl methacrylate
St: Styrene

One hundred parts of styrene-acryl resin, 10 parts of carbon black and 5 parts of polypropylene were mixed up, kneaded, pulverized and then classified, so that a powder having an volume average particle-size of 8 μm could be prepared. Further, 100 parts of the resulting powder and 2 parts of hydrophobic silica having a degree of hydrophobicity of 60 and a primary number average particle-size of 16 nm were mixed up by making use of a Henscheil mixer, so that a toner could be prepared.

Each of the above-mentioned 760 g of carrier and 40 g of toner was mixed up by making use of a V-type mixer under each of the environments for 20 minutes, so that the developer for practical tests could be prepared.

Toner of 1 g and carrier of 19 g each subject to a test were weighed and the weighed carrier and toner were put in a 20 cc-capacity bottle in this order and were then allowed to stand for 3 hours under the testing environmental conditions. Thereafter, by making use of a shaker (Yayoi-type Model New-YS), they were mixed up at a shaking angle of 30° and a shaking frequency of 200 strokes/minute. The results thereof will be shown in Table 2.

Charged amount: A one-minute charge and a 10-minute charge were sampled, respectively, and the charged amounts thereof were measured by making use of a blow-off type charged amount measuring equipment.

Charging raise: Calculated out of a value obtained from 1-minute charged value/10-minute charged value×100(%).

TABLE 2

| | | | Charged amount (μc/g) | | | Charging raise (%) | |
|---|---|---|---|---|---|---|---|
| | Carrier | Toner | 10° C. 10% RH | 33° C. 90% RH | Absolute difference value | 10° C. 10% RH | 33° C. 90% RH |
| Example 1 | C-1 | A | 32.0 | 31.5 | 0.5 | 90 | 98 |
| Example-2 | C-2 | A | 32.5 | 31.5 | 1.0 | 95 | 100 |
| Example-3 | C-3 | A | 32.0 | 31.5 | 0.5 | 90 | 100 |
| Example-4 | C-4 | A | 35.0 | 33.5 | 1.5 | 93 | 100 |
| Example-5 | C-5 | A | 30.0 | 29.5 | 0.5 | 95 | 95 |
| Example-6 | C-6 | A | 29.0 | 28.0 | 1.0 | 93 | 98 |
| Example-7 | C-7 | A | 29.5 | 27.0 | 2.5 | 90 | 98 |
| Comparative example-1 | HC-1 | A | 32.5 | 13.0 | 19.5 | 45 | 80 |
| Comparative example-2 | HC-2 | A | 32.0 | 12.0 | 20.0 | 15 | 60 |
| Comparative example-3 | HC-3 | A | 32.0 | 26.0 | 6.0 | 20 | 65 |
| Comparative example-4 | HC-4 | A | 33.0 | 20.0 | 13.0 | 85 | 85 |
| Comparative example-5 | HC-5 | A | 36.0 | 20.0 | 16.0 | 80 | 90 |
| Comparative example-6 | HC-6 | A | 47.5 | 29.5 | 18.0 | 85 | 90 |

Remarks

R-972: Hydrophilic silica
Methanol number=45
Primary number average particle size=16 nm
Hydrophilic titanium oxide particle:
Methanol number=10
Primary number average particle size=20 nm Bontron E-81: negative charge control agent From the contents of Table 2, it was proved that the developers applied with the negatively chargeable developer carriers of the invention were each proved to be that the charged amount thereof did not depend upon environments and that the charging raise can be accelerated (in other words, the developer mixing speeds can be accelerated).

Example 2

By making use of a copying machine Model U-3035 manufactured by Konica Corp., the practical test results of a negatively chargeable developer carrier were evaluated under the following conditions.

Photoreceptor: A positively chargeable photoreceptor

Charged portions: Discharging polarity was changed from minus polarity into plus polarity.

Photoreceptor potential in imaged portions=750 V

Photoreceptor potential in non-imaged portions=750 V

Image-transferred portions: Discharging polarity was changed from minus polarity into plus polarity.

Developed portions: Development bias=−150 V

[Evaluation Conditions]

Under each of the environmental conditions, the practical copying tests were tried on 3000 sheets. In the tests, the initial developability, image-transferability and the toner flying conditions after completing the 3000-sheet tests were each evaluated. The results thereof will be shown in Table 3.

(1) Developability: It was calculated out of the quantity of toner developed on the photoreceptor per 1 $cm^2$ after developing a 2.0 cm×5.0 cm-sized patch having an original density of 1.3.

(2) Image-transferability: In the same manner as in the developability measurement, it was measured from the proportion of the toner developed on the photoreceptor to the total developed toner quantity.

Image-transferability=A ratio (%) of the quantity of image-transferred toner remaining on a photoreceptor to the quantity of the toner adhered to the photoreceptor (3) Toner flying: A particle-counter was provided to the inside of the copying machine, and the numbers of the toner particles sucked up for 20 seconds were measured under the sucking conditions of 0.51/min, so that the numbers of the toner flied about when completing the 3000-sheet test were counted up.

TABLE 3

| | | Initial developability ($mg/cm^2$) | | Initial image-transferability (%) | | Toner flying after copying 3000 shts (in number) | |
|---|---|---|---|---|---|---|---|
| | Carrier | 10° C. 10% RH | 33° C. 90% RH | 10° C. 10% RH | 33° C. 90% RH | 10° C. 10% RH | 33° C. 90% RH |
| Example-1 | C-1 | 0.85 | 0.84 | 95.0 | 96.0 | 5 | 0 |
| Example-2 | C-2 | 0.80 | 0.82 | 98.0 | 97.0 | 3 | 0 |
| Example-3 | C-3 | 0.80 | 0.80 | 95.0 | 97.0 | 5 | 0 |
| Example-4 | C-4 | 0.81 | 0.83 | 95.0 | 97.0 | 6 | 0 |

TABLE 3-continued

| | Carrier | Initial developability ($mg/cm^2$) | | Initial image-transferability (%) | | Toner flying after copying 3000 shts (in number) | |
|---|---|---|---|---|---|---|---|
| | | 10° C. 10% RH | 33° C. 90% RH | 10° C. 10% RH | 33° C. 90% RH | 10° C. 10% RH | 33° C. 90% RH |
| Example-5 | C-5 | 0.85 | 0.85 | 97.0 | 97.5 | 4 | 0 |
| Example-6 | C-6 | 0.84 | 0.85 | 95.0 | 96.0 | 5 | 0 |
| Example-7 | C-7 | 0.82 | 0.83 | 97.0 | 96.0 | 4 | 0 |
| Comparative example-1 | HC-1 | 0.80 | 1.25 | 95.0 | 45.0 | 130 | 15 |
| Comparative example-2 | HC-2 | 0.82 | 1.30 | 93.0 | 48.0 | 360 | 50 |
| Comparative example-3 | HC-3 | 0.81 | 1.00 | 95.0 | 80.0 | 350 | 60 |
| Comparative example-4 | HC-4 | 0.65 | 1.15 | 94.0 | 75.0 | 15 | 13 |
| Comparative example-5 | HC-5 | 0.65 | 1.20 | 95.0 | 76.0 | 10 | 5 |
| Comparative example-6 | HC-6 | 0.55 | 0.95 | 95.0 | 86.0 | 13 | 6 |

As is obvious from the contents of Table 3, it was proved, when making use of a negatively chargeable developer carrier of the invention, that the image-transferability can be improved and the developability can also be stabilized.

[Advantages of the Invention]

According to a negatively chargeable developer carrier of the invention, (1) the environmental difference of chargeability can be improved; (2) the uniformity of the coated layer of the negatively chargeable developer carrier can also be improved; and (3) the charging raise of the negatively chargeable developer can further be improved and, particularly, the improvement effects of the charging raise can be greatly displayed under the low-temperature and low-humidity conditions.

What is claimed is:

1. A carrier for a negatively chargeable developer comprising magnetic particles onto which a layer of hydrophilic silica, having a degree of hydrophobicity of less than 20, and resin particles are formed by applying a mechanical impact to a mixture of hydrophilic silica and said resin particles.

2. The carrier of claim 1, wherein said magnetic particles have a specific gravity within the range of 3 to 7.

3. The carrier of claim 1, wherein the resin of said resin particles is selected from a styrene resin, an acrylic type resin or a styrene-acrylic resin.

4. The carrier of claim 1, wherein the resin of said resin particles is a styrene-acrylic resin.

5. The carrier of claim 4, wherein said styrene-acrylic type resin is a methyl methacrylate-styrene copolymer.

6. The carrier of claim 1, wherein the specific surface area of said hydrophilic silica has a BET value within the range of 40 to 500 $m^2/g$.

7. The carrier of claim 1, wherein the addition amount of the hydrophilic silica in said layer is within the range of 10 to 70% by weight.

8. The carrier of claim 1, wherein the addition amount of the hydrophilic silica in said layer is within the range of 30 to 60% by weight.

9. The carrier of claim 1, wherein the average particle-size of said hydrophilic silica is within the range of 5 to 50 nm in terms of a primary number average particle size.

* * * * *